US010626622B2

(12) United States Patent
Huang

(10) Patent No.: US 10,626,622 B2
(45) Date of Patent: Apr. 21, 2020

(54) ASSEMBLED FLOOR UNIT

(71) Applicant: SUPER-CLICK TECHNOLOGY CO., LTD., Foshan (CN)

(72) Inventor: Lizhuo Huang, Guangdong (CN)

(73) Assignee: SUPER-CLICK TECHNOLOGY CO., LTD., Foshan (CN)

( * ) Notice: Subject to any disclaimer, the term of this patent is extended or adjusted under 35 U.S.C. 154(b) by 0 days.

(21) Appl. No.: 16/315,421

(22) PCT Filed: Jul. 6, 2017

(86) PCT No.: PCT/CN2017/091943
§ 371 (c)(1),
(2) Date: Jan. 4, 2019

(87) PCT Pub. No.: WO2018/006846
PCT Pub. Date: Jan. 11, 2018

(65) Prior Publication Data

US 2019/0234081 A1 Aug. 1, 2019

(30) Foreign Application Priority Data

Jul. 6, 2016 (CN) ..... 2016 1 0529303
Jul. 6, 2016 (CN) ..... 2016 2 0706607 U

(51) Int. Cl.
*E04F 15/10* (2006.01)
*E04F 15/02* (2006.01)

(52) U.S. Cl.
CPC ..... *E04F 15/107* (2013.01); *E04F 15/02* (2013.01); *E04F 15/02038* (2013.01)

(58) Field of Classification Search
CPC ..... E04F 15/107; E04F 15/02038
See application file for complete search history.

(56) References Cited

U.S. PATENT DOCUMENTS 4,807,412 A * 2/1989 Frederiksen ..... A47G 27/0212 52/177
5,323,575 A * 6/1994 Yeh ..... E04F 21/1844 52/177

(Continued)

FOREIGN PATENT DOCUMENTS

CN 2711300 7/2005
CN 200999444 1/2008

(Continued)

OTHER PUBLICATIONS

International search report dated Oct. 11, 2017 from corresponding application No. PCT/CN2017/091943.

(Continued)

*Primary Examiner* — Rodney Mintz
(74) *Attorney, Agent, or Firm* — Hauptman Ham, LLP

(57) ABSTRACT

The invention relates to an assembled floor unit. The bottom plate of the assembled floor unit is rectangular and comprises a frame and a middle part; the frame is provided with a clamping hook and a clamping groove, the clamping hook is suitable for cooperating with the clamping groove to enable multiple blocks of bottom plates to connect and combine; the frame and the middle part are integrally formed; a plurality of through holes penetrating the thickness direction of the bottom plate are array-distributed in the middle part. The bottom plate has the advantages of material saving, easy manufacture, light weight, and the like. The assembled floor unit with the bottom plate can eliminate the process of embedding a filling layer into the bottom plate, and the light weight but high strength is beneficial to the transportation and export sales of the product.

12 Claims, 10 Drawing Sheets

(56) References Cited

U.S. PATENT DOCUMENTS

| | | | | |
|---|---|---|---|---|
| 6,751,912 | B2 * | 6/2004 | Stegner | E01C 5/20 52/177 |
| 8,726,603 | B2 * | 5/2014 | Huang | E04F 15/02 52/591.1 |
| 9,187,910 | B2 * | 11/2015 | Tortorella | A47G 27/0293 |
| 9,499,979 | B2 * | 11/2016 | Huang | E04F 15/02194 |
| 9,822,533 | B2 * | 11/2017 | Huang | E04F 15/02194 |
| 2002/0189176 | A1 * | 12/2002 | Stegner | E01C 5/20 52/177 |
| 2003/0177728 | A1 * | 9/2003 | Ku | E01C 5/223 52/403.1 |
| 2009/0139159 | A1 | 6/2009 | Hill | |
| 2012/0317911 | A1 * | 12/2012 | Huang | E04F 15/02 52/309.1 |
| 2012/0324816 | A1 * | 12/2012 | Huang | E04F 15/02194 52/311.2 |
| 2014/0109509 | A1 * | 4/2014 | Tortorella | A47G 27/0293 52/747.11 |
| 2017/0073977 | A1 * | 3/2017 | Huang | E04F 15/02194 |
| 2017/0081862 | A1 * | 3/2017 | Gu Bilmez | B29C 45/16 |
| 2019/0117040 | A1 * | 4/2019 | Knight | A47L 23/266 |

FOREIGN PATENT DOCUMENTS

| | | | | |
|---|---|---|---|---|
| CN | 101440659 | | 5/2009 | |
| CN | 101775891 | | 7/2010 | |
| CN | 201730278 | | 2/2011 | |
| CN | 202055469 | | 11/2011 | |
| CN | 102691399 | | 9/2012 | |
| CN | 203213520 | | 9/2013 | |
| CN | 104088438 | | 10/2014 | |
| CN | 105952107 | | 9/2016 | |
| CN | 205777311 | | 12/2016 | |
| EP | 0506499 | | 9/1992 | |
| EP | 1306485 | A1 * | 5/2003 | E04F 15/022 |
| EP | 2199490 | A2 * | 6/2010 | E04F 15/02183 |
| JP | 10-196093 | | 7/1998 | |
| JP | 2000-17820 | | 1/2000 | |
| WO | WO-2015174940 | A1 * | 11/2015 | B29C 45/16 |
| WO | WO-2015174941 | A1 * | 11/2015 | B29C 45/0001 |

OTHER PUBLICATIONS

Office Action dated Oct. 27, 2017 and English translation from corresponding application No. CN 201610529303.1.

Office Action dated Mar. 13, 2018 and English translation from corresponding application No. CN 201610529303.1.

Office Action dated Jun. 5, 2018 and English translation from corresponding application No. CN 201610529303.1.

The Search report dated Oct. 19, 2017 from corresponding application No. CN 201610529303.1.

The Supplementary search report dated Feb. 28, 2018 from corresponding application No. CN 201610529303.1.

* cited by examiner

B

C

B-B

ASSEMBLED FLOOR UNIT

RELATED APPLICATIONS

The present application is a National Phase of International Application Number PCT/CN2017/091943, filed Jul. 6, 2017, and claims the priority of China Application No. 201620706607.6, filed Jul. 6, 2016; and China Application No.

201610529303.1, filed Jul. 6, 2016.

TECHNICAL FIELD

The invention belongs to the field of architectural decoration, and particularly relates to an assembled floor unit and the bottom plate thereof.

BACKGROUND ART

The Chinese utility model patent specification CN202055469U discloses a easy-laying modular floor, which comprises hollow-rectangle-shaped bottom plate frame, a filler plate fixed within the bottom plate frame, and a decorative plate mounting on the surface of the bottom plate frame. Hooks and fasteners are disposed on the side edges of hollow-rectangle-shaped bottom plate frame. The hooks on two sides of the bottom plate frame and the hooks on the other two sides are arranged in a staggered manner. The shape of blocks can be rectangular or square. Each hook comprises a rectangle plate and a raised strip, wherein the rectangle plates of the hooks are arranged on the sides of the bottom plate frame at intervals, and the raised strips of the hooks are arranged on the rectangle plates and parallel to the sides of the bottom plate frame. An inclined plane facing upwards is disposed on the outer side of the raised strip, the inner side of the raised strip is a vertical plane. Fastener is a groove provided under the bottom plate frame arranged on the inside of the rectangle plate. The groove is close to the inner side walls of the bottom plate frame, which are perpendicular to the bottom plate frame. Inclined planes facing downwards are arranged among the rectangle plates on the sides of the bottom plate frame, and the distance between two rectangle plates is larger than or equal to the width of each rectangle plate.

The laying and assembling of above modular floor are convenient, but the manufacturing process is slightly complicated. As shown in FIG. 1, the bottom plate frame of the modular floor includes a frame 01 and an embedded cavity 02 in the middle of the frame. The filling plate is embedded in the embedded cavity 02. Therefore, when manufacturing, the bottom plate frame first needs to be made, then the filling plate is inserted into the bottom plate frame, at last the decorative plate is mounted on the surface of the bottom plate frame so as to form a modular floor for final sale and use. In this type of modular floor, in order to ensure the strength, the bottom plate frame is made of engineering materials such as ABS plastic or PS plastic. Because the price of above engineering materials are relatively high, so only bottom plate frame use said engineering plastic. The filling plate is embedded to finish the mounting surface of the bottom plate frame. The material of the filling plate is PVC or EVA, which have low price and are easy to process. The combination of the bottom plate frame and the filling plate can effectively reduce the material cost, then the decorative plate could be attached. However, while reducing the material costs, it also has to add extra corresponding processes, i.e. a process of manufacturing filling plates, a process of inserting the filling plate, a process of bonding a filling plate and the like, and the above-described steps require a large number of workers to complete. Nowadays, under the circumstance of increasing labor costs, it will greatly increase production costs. Furthermore, the existing modular floor has greater weight and is not convenient for transportation, that will increase the cost of export sales. Therefore, the applicant believes that it is necessary to improve the structure of the existing modular floor.

Contents of Invention

In order to overcome the deficiencies of the prior art, it is an object of the present invention to provide an assembled floor unit and a bottom plate thereof, which are simple to manufacture and material-saving, thereby reducing production costs.

One of the objects of the present invention is achieved by the following technical solution: a bottom plate of a modular floor unit comprising a frame and a middle part; the bottom plate comprising a first surface and a second surface, at least one pair of opposite sides of the frame being provided with clamping grooves, the opening side of the clamping grooves facing the second surface; a plurality of clamping hooks extending outwardly from at least one pair of opposite sides respectively, the hook portion at the end of the hook extending away from the second surface; the clamping hook being suitable to be engaged with the clamping groove on the other bottom plate to combine multiple bottom plates, the frame and the middle part being integrally formed; and a plurality of through holes penetrating the thickness direction of the bottom plate being array-distributed as a matrix in the middle part.

Wherein, the middle part of the bottom plate is a grid plate, and the grid plate includes evenly distributed rectangle-shaped grid holes, and a part of the grid holes are configured as said through holes.

Wherein, the first surface of the middle part is provided with at least one reinforcing strip covering part of the grid holes of the grid plate, the surface of the reinforcing strip is flush with the first surface, and the reinforcing strip is laterally and/or longitudinally connected to the frame, and is integrally formed with middle part and the frame.

Wherein, the thickness of the reinforcing strip is 1-1.5 mm (0.039-0.059 inch) in the thickness direction of the bottom plate.

Wherein, a plurality of long-circle main-holes are array-distributed in said middle part, and the first long annular rib plates extend along the hole edges of the long-circle main-holes and toward the second surface of the bottom plate, the ends of the first long annular rib plates are at the same level as the second surface of the bottom plate; the adjacent two first long annular ribs are connected by strip ribs, and the outermost first long annular ribs are connected to the frame by strip ribs.

Wherein, a plurality of long-circle sub-holes are array-distributed in the middle part, the long-circle sub-holes and the long-circle main-holes are alternately distributed, second long annular rib plates extends along the hole edges of the long-circle sub-holes towards the second surface of the bottom plate, and the ends of the second long annular ribs are at the same level as the second surface of the bottom plate.

Wherein the frame includes reinforcing ribs extending from the root of the hook towards the edge of the middle part.

Wherein, the reinforcing ribs are orthogonal to the wall and the bottom of the clamping groove.

Wherein, both ends of the clamping groove are open.

Wherein, the corners of the second surface of the bottom plate are provided with reinforcing points extending from the bottom of the clamping groove to the second surface, and the end of the reinforcing points are flush with the second surface of the bottom plate or between the groove bottom and the second surface of the clamping groove.

Wherein, a plurality of thickening ribs are extended outwardly from the back surface of the bottom plate along its thickness direction, and the distances of the thickening ribs extending outward are equal.

Wherein, a plurality of thickening columns are provided between thickening ribs and extend outwardly along the thickness direction of the bottom plate, and the distance of the thickening columns extending outward is equal to that of the thickening ribs extending outward.

Wherein, the integral forming is injection molding.

Wherein, the bottom plate is made of ABS engineering plastic or PS engineering plastic.

A second object of the present invention is achieved by the following technical solution: an assembled floor unit comprising the above-described bottom plate and a decorative plate mounted on the first surface of the bottom plate.

Compared with the prior art, the present invention has the following beneficial effects:

The bottom plate of the assembled floor unit in the present invention has the advantages of easy assembling and easy laying. In addition, in respect of manufacture, the bottom plate is obtained by integral molding, so that it has high production efficiency, few production process, and reduced labor cost. In terms of structure, the middle part of the bottom plate is provided with through holes penetrating through the thickness direction of the bottom plate, the presence of through holes can greatly save material. Therefore, the bottom plate has a few of merits of material saving, easy manufacture, and light weight. The floor assembling process with such a bottom plate can eliminate the step of embedding the filling layer on the bottom plate, thereby reducing the labor costs and reducing the weight of the entire floor unit. As the weight is reduced, transportation becomes more convenient, which further facilitates the export sales of the product.

The bottom plate in the assembled floor unit of the prior art is limited by the traditional wooden floor, composite floor design standards and customary, and tends to adopt a frame and a filling structure to achieve sufficient mechanical strength and deformation resistance, and it is generally considered that the bottom plate of the integrated structure cannot satisfy the stability requirements for floor. Nevertheless, the present invention has taken a different approach and adopted the bottom plate made by the integral molding technology, overcomes the technical prejudice, and guarantees sufficient structural stability of the floor through the design and quality control of the integrally formed structure.

Figure 1:
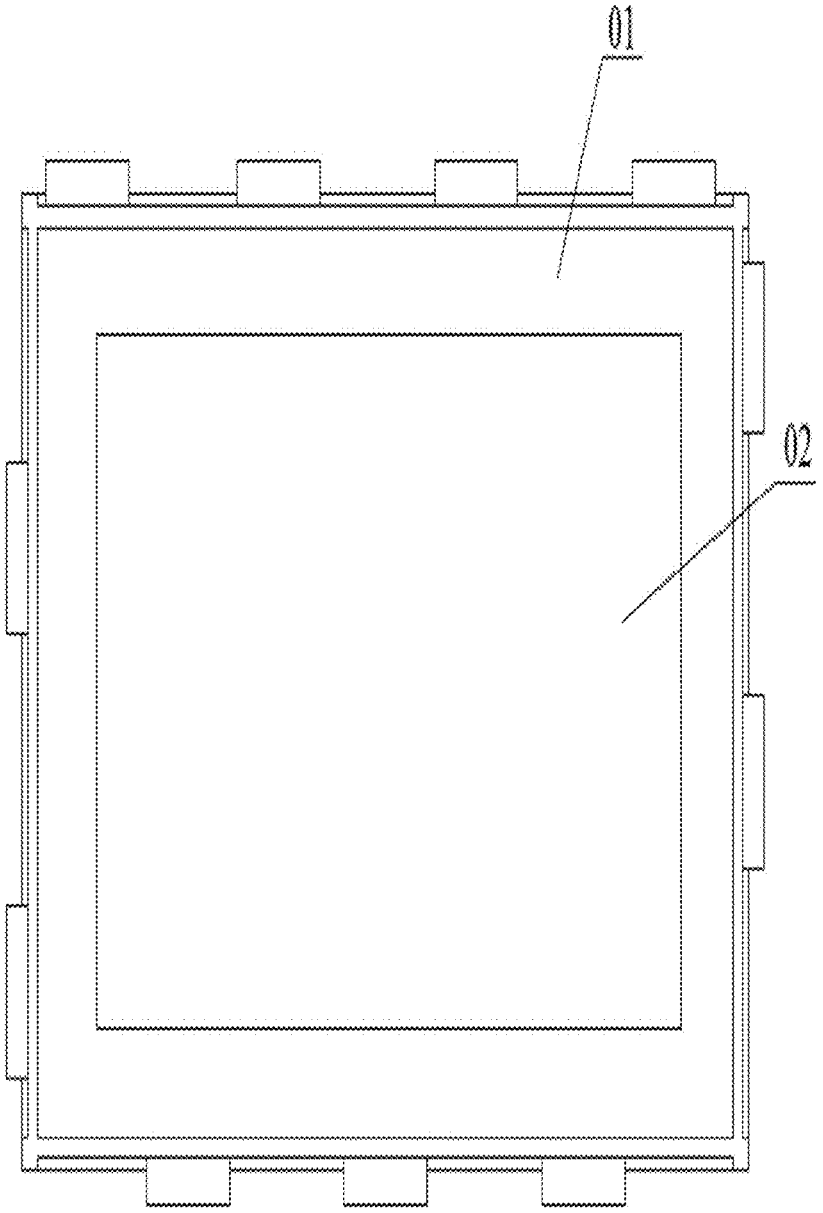
FIG. 1 is a schematic structural view of a frame-type bottom plate in the prior art.

Reference numerals in the drawings represent as follows:

01—frame, 02—embedded cavity;

1—frame, 11—clamping groove, 11*a*—opening side of clamping groove, 11*b* groove bottom, 12—clamping hook, 12*a*—hook portion, 13—reinforcing rib;

2—grid plate, 21—reinforcing strip, 22—sidewall of grid plate, 23—grid hole;

3—reinforcing point;

41—long-circle main-hole, 42—first long annular rib, 43—strip rib,

44—long-circle sub-hole, 45—second long annular rib

51—thickening rib, 52—thickening column

6—decorative plate

SPECIFIC MODE FOR CARRYING OUT THE INVENTION

Exemplary embodiments, features, and aspects of the invention are described in detail below with reference to the drawings. The same reference numerals in the drawings denote the same or similar elements. The various aspects of the embodiments are shown in the drawings, and the drawings are not necessarily drawn to scale unless otherwise indicated.

It should be noted that the "front side" and "back side" mentioned in the following embodiments are relative to the side of the bottom plate for mounting a decorative plate, specifically, the side of the bottom plate for mounting the decorative plate is "front", correspondingly, the opposite side of the "front" is the "back".

In the following embodiments, the structure of the clamping hook and the clamping groove of the bottom plate and the assembly between the adjacent bottom plates are the same as those disclosed in the Chinese Utility Model Patent Specification CN202055469U, and will not be described in detail herein.

Example 1 of Bottom Plate

Figure 2:
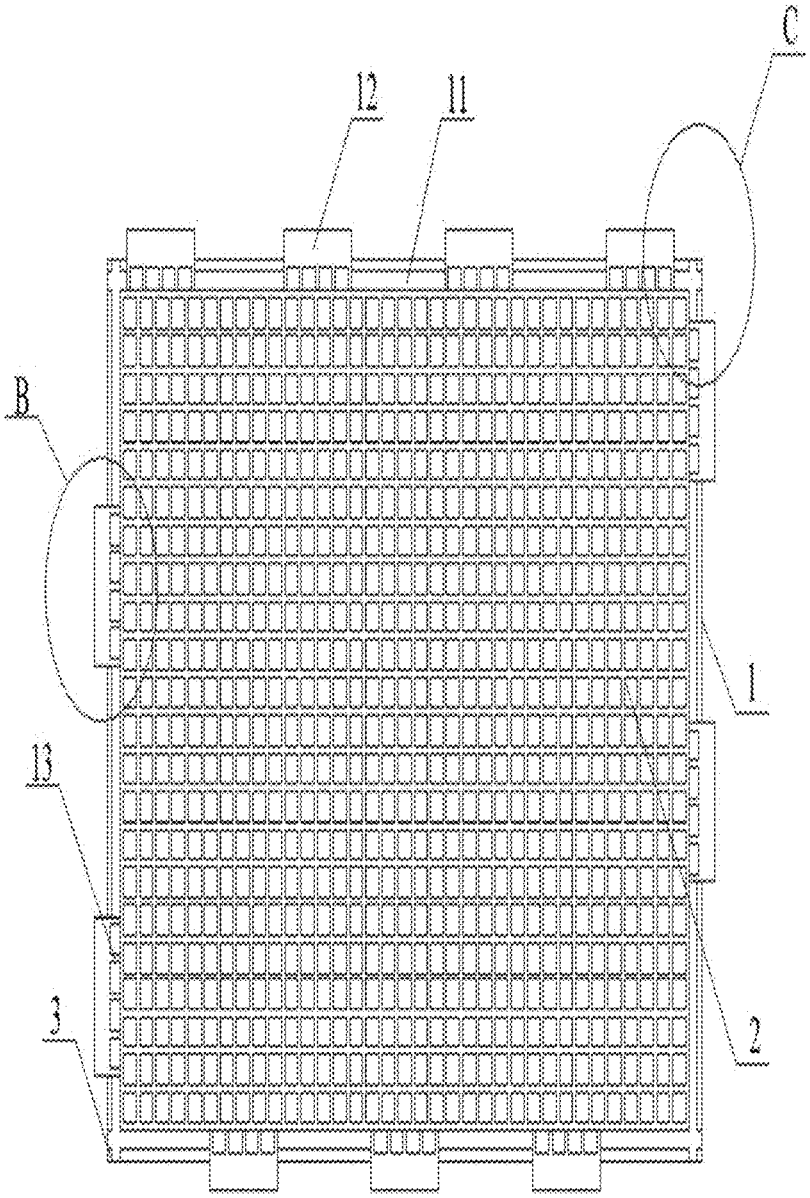
FIG. 2 is a schematic structural view showing the back side of a bottom plate of example 1 in the present invention.
Figure 6:
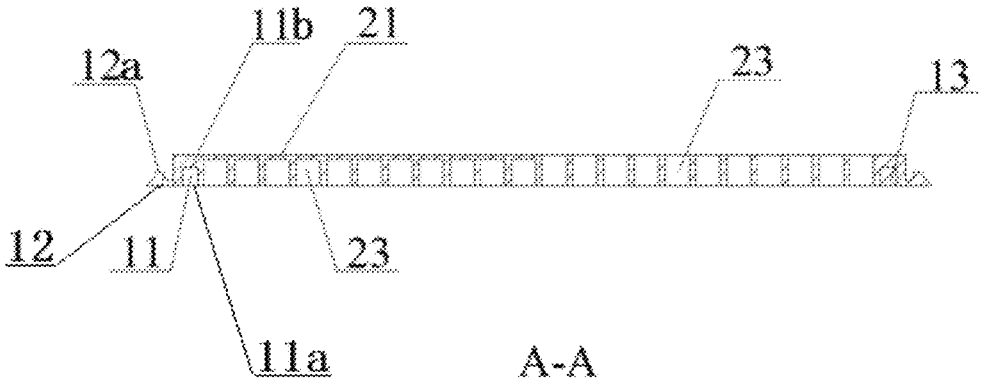
FIG. 6 is a cross-sectional view taken along line A-A of FIG. 3.

As shown in FIG. 2 and FIG. 6, a bottom plate of an assembled floor unit is preferably rectangular, and specifically may be rectangular or square. Of course, in practical applications, diamonds, octagons, hexagons, and other special shapes with curved edges are also possible. In the present embodiment, a rectangle is employed.

The bottom plate includes a frame 1 and a middle part. The bottom plate has a first surface and a second surface, the first surface being a front surface and the second surface being a back surface. At least one pair of opposite sides of the frame is provided with a clamping groove, and plurality of clamping hooks extend outwardly from at least one pair of opposite sides respectively. In this embodiment, a clamping groove 11 is formed on the back surface of the bottom plate along the side of the frame 1. The opening side 11*a* of the clamping groove 11 faces the back surface of the bottom plate. The clamping hook 12 extends outwardly from the frame 1 along the length direction and the width direction of the bottom plate, and the distal end of each clamping hook 12 extends away from the back side of the bottom plate, that is, the hook portion of the hook 12 faces the front surface of the bottom plate. The hooks 12 are capable of cooperating with the clamping groove 11 on the other bottom plate in order to assemble and integrate multiple bottom plates together through the engagement of the clamping hooks 12 and the clamping groove 11. The frame 1 and the middle part 2 are integrally formed, that is, the bottom plate is formed one-piece. In the present embodiment, the middle part of the bottom plate is configured as a grid plate 2, and a plurality of grid holes 23 of the grid plate 2 go through the whole thickness of the bottom plate. The grid plate 2 in this embodiment includes a plurality of grid walls uniformly arranged in a lateral direction, and a plurality of grid walls uniformly arranged in a longitudinal direction intersecting therewith. Adjacent lateral and longitudinal sides of the grid wall define a plurality of said grid holes 23. The grid walls have a uniform thickness.

The bottom plate is an integrally formed plate which can be obtained by injection molding. In order to ensure the strength of the bottom plate, the bottom plate in the embodiment is made of ABS engineering plastic, and PS engineering plastics and the like can also be used. The bottom plate of this structure has the following advantages:

(1) The bottom plate of the present invention is obtained by integral molding, which has simple process and high efficiency. In addition, integral molding manufacturing can ensure the integrity of the bottom plate and thus its strength.

(2) The middle part of the bottom plate adopts a grid plate structure, and the grid plate 2 has a plurality of grid holes 23 therein. The presence of the grid holes 23 can greatly save material, and at the same time, the special configuration of the grid plate 2 achieves good strength and stiffness in the thickness direction are good, and although the material is reduced, it still satisfies mechanical requirements.

In the present embodiment, the grid plate 2 includes uniformly distributed rectangle grid holes. Specifically, the grid holes 23 are square holes having a side length of 5-6 mm (0.197-0.236 inch), preferably 5.5 mm (0.217 inch), and the wall of the grid holes 23 (i.e., the grid wall) has a thickness of 1-1.3 mm (0.039-0.051 inch), preferably 1.1 mm (0.043 inch). Above-mentioned size range not only enables the bottom plate to meet the mechanical requirements and reduce materials, but also provides sufficient foot comfort, and further prevents the surface of the decorative plate from grid marks appearing on the surface of the decorative plate after long-term use.

In addition, the traditional filling board is made of PVC material, which has strong water absorption, so that the weight of the whole bottom plate will be greatly increased after water absorption, and the excessive storage of water in the bottom plate also will shorten the life of the material. In contrast, the bottom plate of the present invention adopts engineering plastics which are not absorbent, and the grid holes 23 of the grid plate 2 are also capable of draining effectively.

Figure 3:
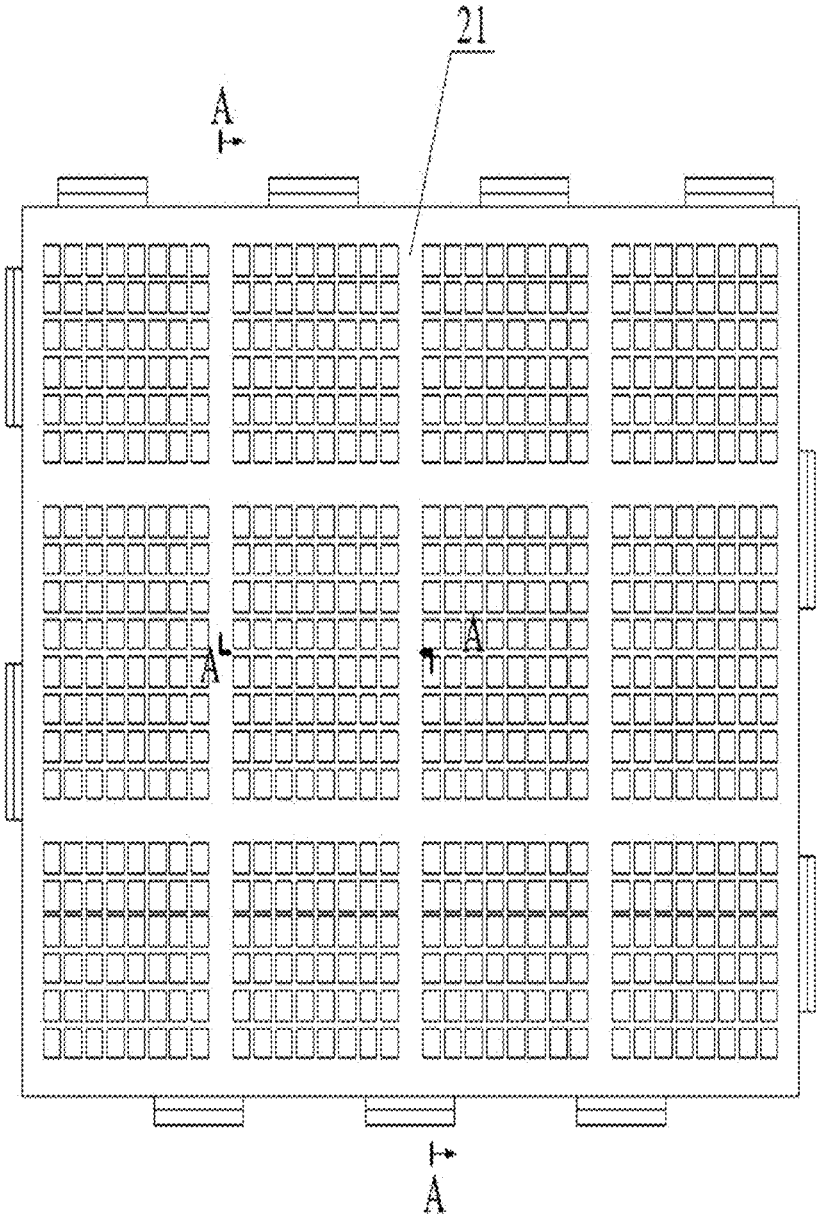
FIG. 3 is a schematic structural view showing the front side of a bottom plate of example 1 in the present invention.

In this embodiment, as shown in FIG. 3 and FIG. 6, the front surface of the bottom plate is provided with reinforcing strips 21 covering the grid holes 23 in the partial grid plate 2, and the surface of the reinforcing strips 21 is flush with the front surface of the bottom plate. The reinforcing strips 21 are integrally formed with the middle part and the frame 1. The reinforcing strips 21 are laterally and/or longitudinally connected to the frame 1 of the bottom plate. The reinforcing strips 21 can increase the strength of the whole bottom plate to prevent it from deformation, and the reinforcing strips 21 can also serve as glue attachment points when the decorative plate is subsequently attached.

Due to the large surface area of the reinforcing strips 21, more glue can be adhered to the bottom plate to improve the bonding quality of the assembled floor unit. Due to the coverage of the reinforcing strips 21, only a part of the grid holes 23 constitute arrays of through holes in the thickness direction of the bottom plate. In terms of thickness selection of the reinforcing strips 21, it is set to be 1-1.5 mm (0.039-0.059 inch) in the thickness direction of the bottom plate, specifically 1.2 mm (0.047 inch) in the present embodiment. The selection of the thickness combines various factors: if the reinforcing strip 21 is designed to be too thick, it will consume more engineering plastics, increase manufacturing costs and weight of the bottom plate, otherwise, if the reinforcing strip 21 is designed to be too thin, greater flow resistance of the liquid plastic during injection molding will not be conductive to the convergence of liquid plastic, which in turn will cause holes in the reinforcing strips 21 to deteriorate the appearance and performance of the product. Therefore, above thickness range is a desirable thickness range.

Figure 4:
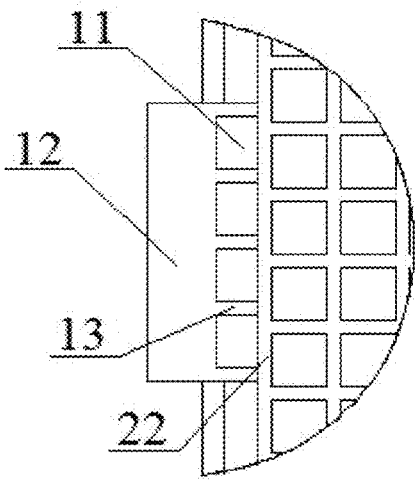
FIG. 4 is a partial enlarged view of B in the FIG. 2.

FIG. 1 illustrates the structure of a conventional bottom plate at the position where the hook is disposed, wherein the clamping hooks, the clamping groove and the middle part are sequentially arranged from the outside to the inside. This kind of structure has the following problems in actual production: (1) the clamping hooks are easy to be bent when subjected to force; (2) dents are prone to appear on the front side of the bottom plate corresponding to the positions of the clamping groove at the root of the hooks, and the dents are probably caused by a sudden change in the thickness of the structure around the clamping groove at the root of the hooks in the process of injection molding. However, the present invention improves the structure at the position where the hooks 12 are disposed, as shown in FIGS. 2 and 4. The frame 1 includes reinforcing ribs 13 extending from the root of the hooks 12 toward the edge of the middle part. With the provision of the reinforcing rib 13, the root of the hooks is tensioned to effectively prevent from being bent. Furthermore, the reinforcing ribs 13 are orthogonal to the wall and bottom of the clamping groove 11, so that the sudden change of thickness at the root of hooks 12 corresponding to the clamping groove 11 are alleviated to prevent the occurrence of dents. Therefore, the improvement of the reinforcing ribs 13 has both of above advantages.

Figure 5:
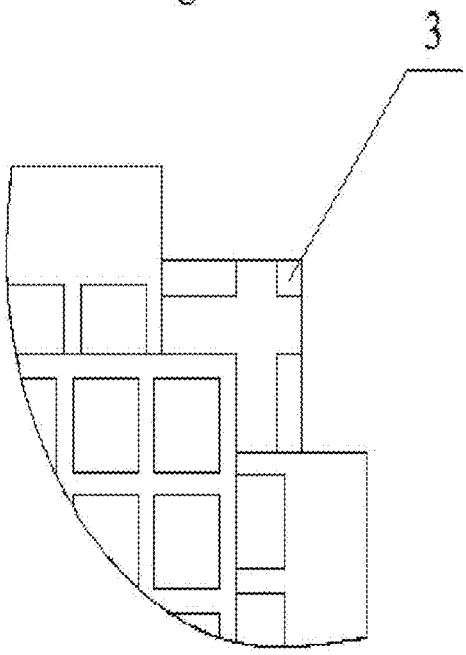
FIG. 5 is a partial enlarged view of C in the FIG. 2.

The structure of the conventional bottom plate at the corners is as shown in FIG. 1. The thickness at the corners is the same as that at the clamping groove, which is relatively thin, so that the product is weak at the corners which are easily deformed when releasing from the mold. If the corners are deformed, glue would not be well adhered in the subsequent adhesive process and the bottom plate also could not be well combined with decorate boards at corners, thus product yield will decline. The present invention improves the corners of the bottom plate. As shown in FIG. 2 and FIG. 5, the corners of the back surface of the bottom plate are provided with reinforcing points 3 extending from the groove bottom 11*b* to the back surface of the bottom plate. The end of the reinforcing points 3 is flush with the second surface of the bottom plate or between the groove bottom 11*b* and the second surface, that is, the corner is thickened. The thickening process can enhance the strength at the corners and reduce the chance of deformation at the corners.

Example 2 of Bottom Plate

Figure 7:
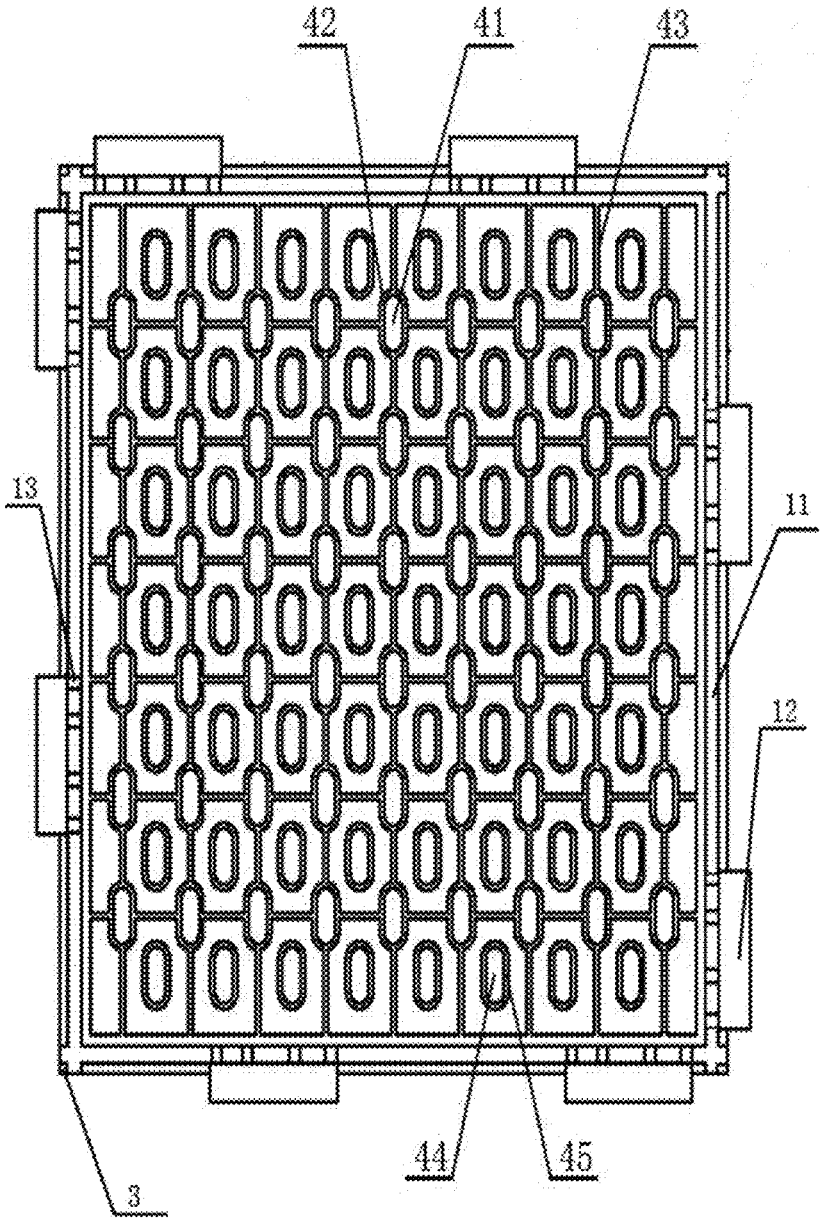
FIG. 7 is a schematic structural view showing the back side of a bottom plate of example 2 in the present invention.
Figure 8:
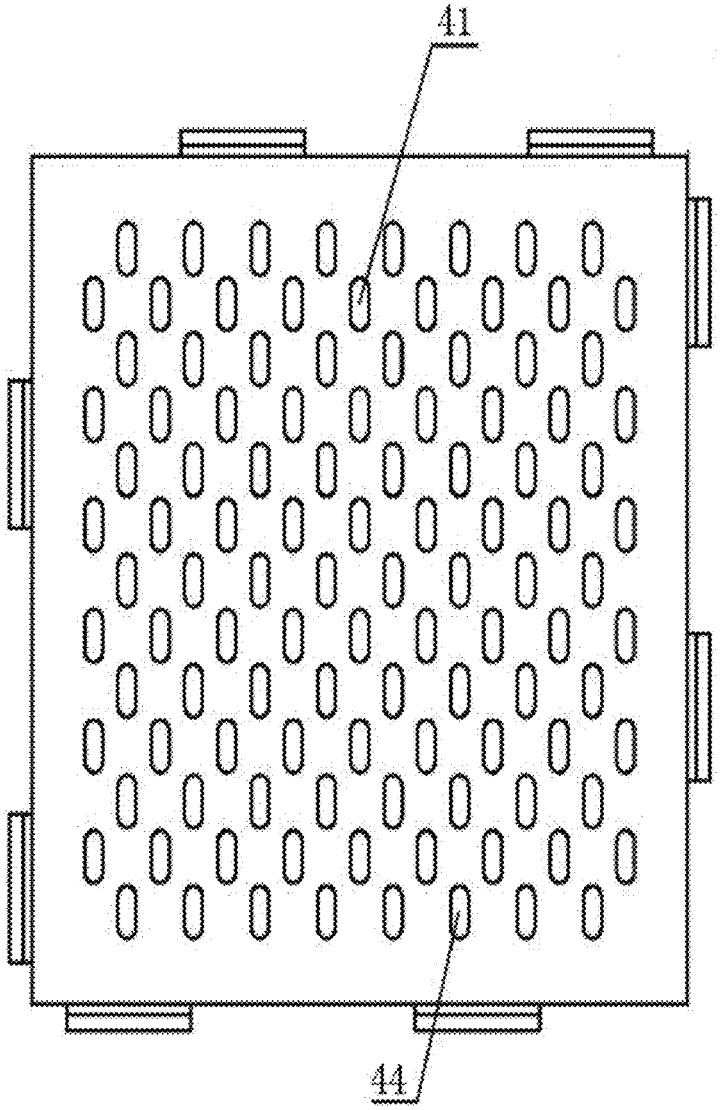
FIG. 8 is a schematic structural view showing the front side of a bottom plate of example 2 in the present invention.

The configuration in this embodiment is substantially the same as the first embodiment except that the middle part of the bottom plate is different. As shown in FIG. 7 and FIG. 8, a plurality of long-circle main-holes are array-distributed in the middle part. First long annular rib plates 42 extend along the hole edges of the long-circle main-holes 41 and toward the back surface of the bottom plate. The ends of the first long annular rib plates 42 are at the same level as the back surface of the bottom plate. A strip rib is provided between two adjacent first long annular ribs 42 and connects them. The outermost first long annular ribs 42 are connected to the frame by the strip ribs 43. At the same time, a plurality of long-circle sub-holes are array-distributed in the middle part. The long-circle main-holes 41 and the long-circle sub-holes 44 are alternately distributed. Second long annular rib plates 45 extends along the hole edges of the long-circle sub-holes 44 and toward the back surface of the bottom plate. The second long annular ribs 45 are disposed between the strip ribs 43, and the ends of the second long annular ribs 45 are at the same level as the back surface of the bottom plate. Thus, the above-mentioned long annular ribs supports the bottom plate and the bottom plate will not be depressed by the force. In the present embodiment, the long-circle sub-holes 44 have the same structure as the long-circle main-holes 41, further reducing the amount of material, weight and production cost. In consequence, the long-circle main-holes 41 and the long-circle sub-holes 44 can avoid stress concentration, greatly increase the strength and stiffness of the bottom plate, better prevent deformation and improve the load capacity of the bottom plate. In the present embodiment, the long-circle main-holes 41 and the long-circle sub-holes 44 have a hole diameter of 5-6 mm (0.197-0.236 inch), preferably 5.5 mm (0.217 inch), and a length of 8-12 mm (0.315-0.472 inch), preferably 10 mm (0.394 inch). The strip ribs 43 have a thickness of 1-1.3 mm (0.039-0.051 inch), preferably 1.2 mm (0.047 inch). The above-mentioned size range not only enables the bottom plate to meet the mechanical requirements and save material, but also provides sufficient foot comfort and prevents marks of the long-circle holes from appearing on the surface of the decorative plate after long-term use of the assembled floor unit. In this embodiment, as shown in FIG. 7, both ends of the clamping groove are open, that is, the reinforcing points 3 are not connected to the walls of the clamping groove 11. The opening It is used for sliding the hook 12 into or out when the bottom plate is disassembled, so that the bottom plate can be assembled without first aligning completely, and plural bottom plates can be aligned after assembled together, which is more convenient when disassembling. In the present embodiment, the long-circle main-holes 41 and the long-circle sub-holes 44 are distributed in an array in the middle part of the bottom plate, and this way of distribution is only a preferred one. It is also possible to provide annular array, diamond array, or other-shaped distribution, as long as a plurality of through holes are provided to reduce the amount of material and the weight of the bottom plate, all these kinds of design also fall within the scope of the present invention.

Example 3 of Bottom Plate

Figure 9:
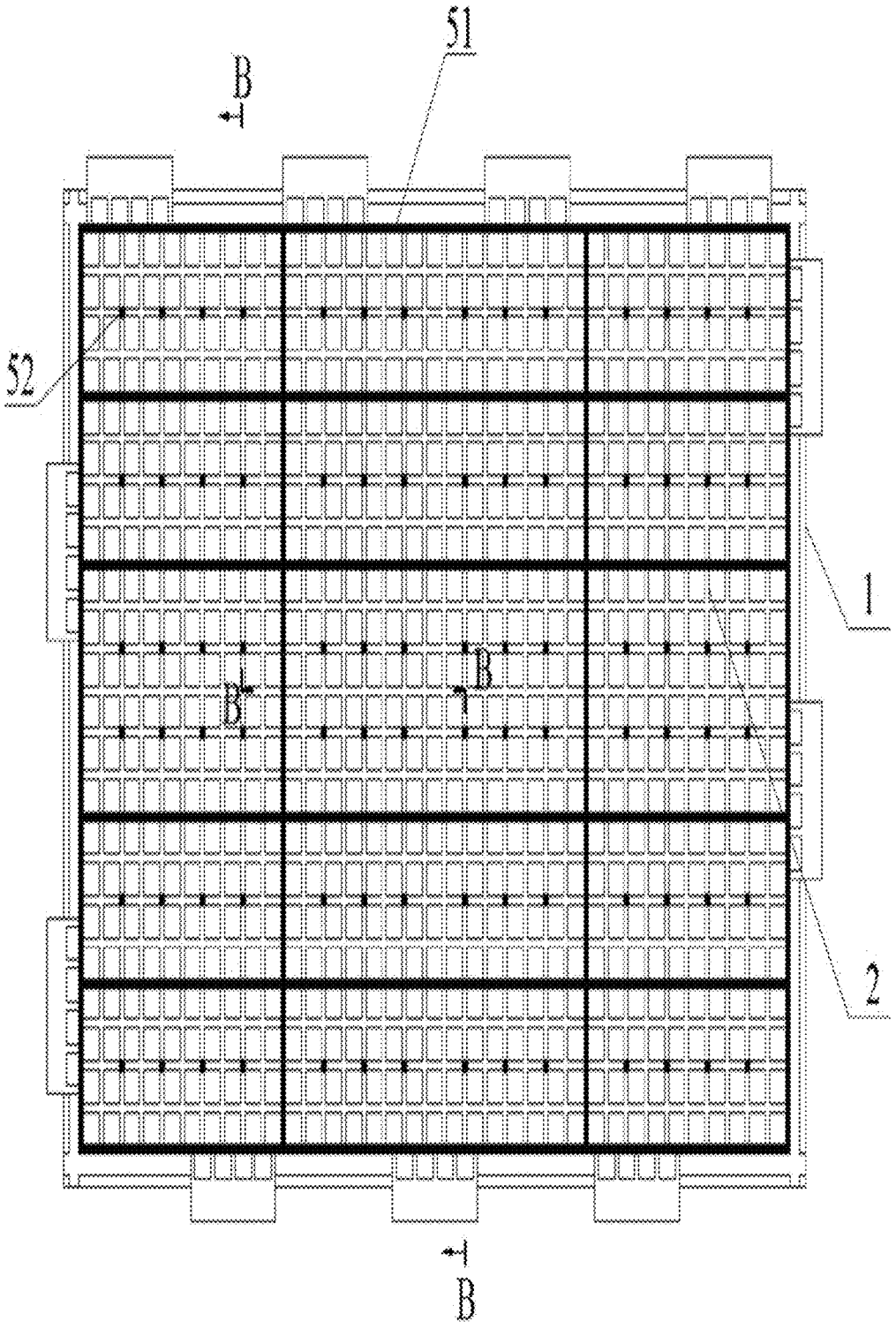
FIG. 9 is a schematic structural view showing the back side of a bottom plate of example 3 in the present invention.
Figure 10:
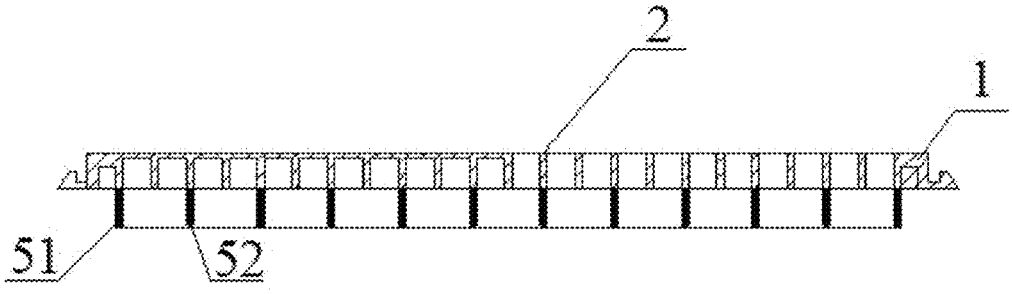
FIG. 10 is a cross-sectional view taken along line B-B of FIG. 9, wherein the front side of the bottom plate facing upward and the back side facing downward.

In practical applications, the assembled floor units described in this paper sometimes may be used to replace the damaged floor in the home. For instance, in case of the household pure wooden floor being damaged by moisture, it could be replaced with the assembled floor unit described in the present invention. However, current pure wood flooring usually has relatively great thickness, even up to 20 mm (0.787 inch), and the assembled bottom plate unit described herein is not suitable due to insufficient thickness. Under this circumstance, as shown in FIGS. 9 and 10, thickening ribs 51 and thickening columns 52 may be provided on the back surface of the bottom plate of the present invention to increase the thickness of the bottom plate, wherein the thickening ribs 51 and thickening columns 52 are integrally molded with the bottom plate for easy manufacturing. In FIGS. 9 and 10, darker parts represent the thickening ribs 51 and the thickening columns 52 for better illustration of their position and thickness. Referring to FIG. 9 and FIG. 10, a plurality of thickening ribs 51 are extended outwardly from the back surface of the bottom plate along its thickness direction, and the thickening ribs 51 can increase the thickness of the bottom plate and provide a stable support due to their distribution throughout. Meanwhile, for saving material, multiple thickening columns 52 are separately provided between thickening ribs 51 and extended outwardly along the thickness direction of the bottom plate. Both the thickening ribs and the thickening columns have the same length of outward extension, that is, the ends of both are at the same level, which make them capable of working together to provide a stable support for the bottom plate. The above structure increases the thickness of the bottom plate by adding the thickening ribs 51 and the thickening columns 52, and the thickness can vary according to the actual requirements of customers. By providing extra thickening ribs 51 and thickening columns 52 without increasing the thickness of bottom plate itself, the thickening ribs 51 and the thickening columns 52 are sufficient to support the bottom plate due to high engineering strength, and effectively saving materials and reducing production costs. In FIG. 9 and FIG. 10, a plurality of crossed thickening ribs 51 constitute closed rectangles. It will be appreciated by those skilled in the art that such an arrangement and the enclosed shape are only preferred. However, as long as a thickening structure is provided to achieve the purpose of thickening the bottom plate, other arrangements or enclosing patterns shapes are also within the scope of the present invention.

Assembled Floor Unit

Figure 11:
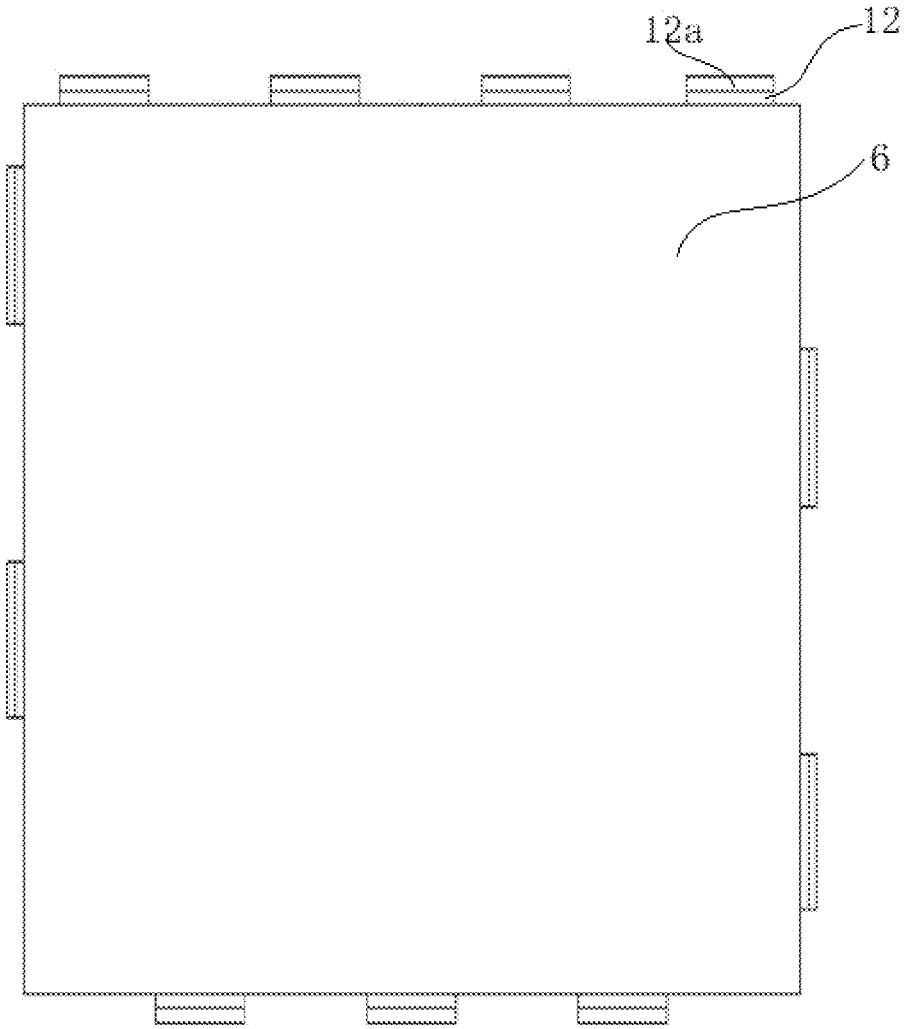
FIG. 11 is a schematic structural view showing an assembled floor unit comprising a bottom plate of example 1 according to the present invention.
Figure 12:
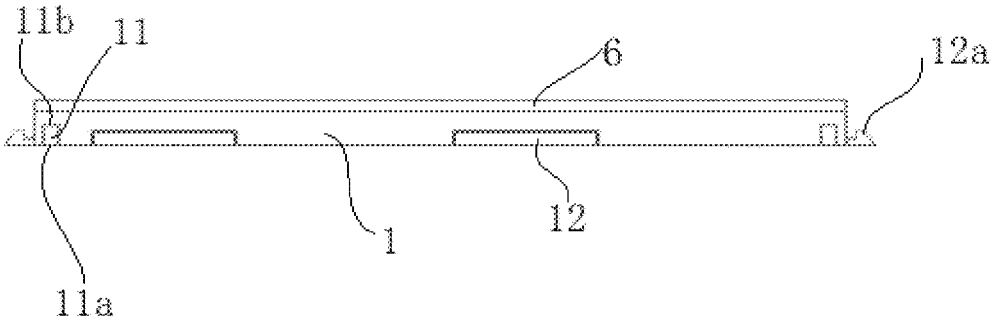
FIG. 12 is a left view of the assembled floor unit in the FIG. 11.

In FIG. 11 and FIG. 12, the present invention also provides an assembled floor unit comprising a bottom plate and a decorative plate 6, the bottom plate being the above-mentioned bottom plate, and the decorative plate 6 being mounted on the front surface of the bottom plate. The decorative plates 6 could be PVC decorative plates, EVA decorative plates or linen decorative plates.

Finally, it should be noted that the above-described embodiments are only for explaining the technical solutions of the present invention, and are not intended to be limiting. Although the present invention has been described in detail with reference to the foregoing embodiments, those skilled in the art should understand that the technical solutions described in the foregoing embodiments may be modified, or some or all of the technical features may be equivalently replaced; and the modifications or substitutions do not deviate from the scope of the technical solutions of the present invention.

What is claimed is:

1. An assembled floor unit, comprising:

a bottom plate comprising a first surface and a second surface, and a decorative plate mounted on the first surface of said bottom plate;

said bottom plate comprises a frame and a middle part, the middle part having an edge;

at least one pair of opposite sides of said frame being provided with a clamping groove respectively, an opening side of said clamping groove facing the second surface;

a plurality of clamping hooks extending outwardly from said at least one pair of opposite sides respectively, a hook portion at an end of said hooks extending away from the second surface;

said clamping hooks being configured to be engaged with a corresponding clamping groove on another bottom plate to combine multiple bottom plates, wherein said frame includes at least one reinforcing rib extending from a root of said hooks towards the edge of said middle part, wherein said frame and said middle part are integrally injection molded and are composed of ABS engineering plastic or PS engineering plastic and respective upper surfaces thereof are at same level as the first surface;

a plurality of through holes penetrating a thickness direction of the bottom plate are array-distributed in said middle part; and the decorative plate is adhered with glue to the upper surfaces of said frame and said middle part.

2. The assembled floor unit according to claim 1, wherein both ends of said clamping groove are open.

3. The assembled floor unit according to claim 1, wherein a plurality of long-circle main-holes are array-distributed in said middle part, and a first long annular rib plates extend along hole edges of the long-circle main-holes and toward the second surface of said bottom plate, ends of the first long annular rib plates are at the same level as the second surface of said bottom plate; two adjacent first long annular ribs are connected by strip ribs, and a outermost first long annular ribs are connected to said frame by strip ribs.

4. The assembled floor unit according to claim 3, wherein a plurality of long-circle sub-holes are array-distributed in said middle part, said long-circle sub-holes and said long-circle main-holes are alternately distributed, second long annular rib plates extends along hole edges of said long-circle sub-holes towards the second surface of said bottom plate, and ends of the second long annular ribs are at the same level as the second surface of said bottom plate.

5. The assembled floor unit according to claim 1, wherein a plurality of thickening ribs are extended outwardly from a back surface of said bottom plate along the thickness direction of said bottom plate, and distances of each thickening ribs extending outward are equal.

6. The assembled floor unit according to claim 5, wherein a plurality of thickening columns are provided between said thickening ribs and extend outwardly along the thickness direction of said bottom plate, and the distance of said thickening columns extending outward is equal to that of said thickening ribs extending outward.

7. The assembled floor unit according to claim 1, wherein the middle part of said bottom plate is a grid plate, and said grid plate includes evenly distributed rectangle grid holes, and a part of said grid holes are configured as said through holes.

8. The assembled floor unit according to claim 7, wherein the first surface of said middle part is provided with at least one reinforcing strip, said reinforcing strip covering a part of the grid holes of said grid plate, a surface of said reinforcing strip is at the same level as the first surface, and said reinforcing strip is laterally or longitudinally connected to said frame, and is integrally formed with said middle part and frame.

9. The assembled floor unit according to claim 8, wherein a thickness of said reinforcing strip is 1-1.5 mm (0.039-0.059 inch) in the thickness direction of said bottom plate.

10. The assembled floor unit according to claim 1, wherein the at least one reinforcing rib is a plurality of reinforcing ribs, and said frame includes the reinforcing ribs extending from the root of said hooks towards the edge of said middle part.

11. The assembled floor unit according to claim 10, wherein said reinforcing ribs are orthogonal to a wall and a bottom of said clamping grooves.

12. The assembled floor unit according to claim 11, wherein corners of the second surface of said bottom plate are provided with reinforcing points extending from the bottom of the clamping groove to the second surface, and ends of said reinforcing points are flush with the second surface of said bottom plate or between the groove bottom and second surface of said clamping grooves.

* * * * *